US009125546B2

(12) United States Patent
Kleemann et al.

(10) Patent No.: US 9,125,546 B2
(45) Date of Patent: Sep. 8, 2015

(54) DOMESTIC APPLIANCE

(75) Inventors: Andreas Kleemann, Kalletal (DE); Eduard Thielmann, Lage (DE); Dieter-Hermann Waltemate, Hüllhorst (DE); Alexander Buschmann, Herford (DE)

(73) Assignee: HETTICH-ONI GMBH & CO. KG, Vlotho (DE)

( * ) Notice: Subject to any disclaimer, the term of this patent is extended or adjusted under 35 U.S.C. 154(b) by 235 days.

(21) Appl. No.: 13/579,194

(22) PCT Filed: Feb. 14, 2011

(86) PCT No.: PCT/EP2011/052154

§ 371 (c)(1),
(2), (4) Date: Oct. 4, 2012

(87) PCT Pub. No.: WO2011/101319

PCT Pub. Date: Aug. 25, 2011

(65) Prior Publication Data

US 2013/0033160 A1 Feb. 7, 2013

(30) Foreign Application Priority Data

Feb. 16, 2010 (DE) ..... 20 2010 000 209 U

(51) Int. Cl.
*A47L 15/42* (2006.01)
*F25D 23/10* (2006.01)

(52) U.S. Cl.
CPC ..... *A47L 15/4265* (2013.01); *F25D 23/10* (2013.01)

(58) Field of Classification Search
CPC ..... F25D 23/028
USPC ..... 312/291, 295, 319.1, 333, 334.44, 312/334.46, 405
See application file for complete search history.

(56) References Cited

U.S. PATENT DOCUMENTS

| | | | | |
|---|---|---|---|---|
| 3,367,730 | A * | 2/1968 | Andrews et al. | 312/204 |
| 4,514,021 | A * | 4/1985 | Sundermeier et al. | 312/291 |
| 4,660,881 | A * | 4/1987 | Komeya et al. | 296/37.9 |
| 4,828,344 | A * | 5/1989 | Omata | 312/319.1 |
| 5,820,238 | A * | 10/1998 | Lambright | 312/291 |
| 2003/0067257 | A1 * | 4/2003 | Gasser | 312/331 |

(Continued)

FOREIGN PATENT DOCUMENTS

| | | |
|---|---|---|
| DE | 75 28 875 | 9/1975 |
| DE | 33 04 034 | 8/1984 |

(Continued)

OTHER PUBLICATIONS

German Office Action for Application No. 20 2010 000 209.5, dated Feb. 16, 2010.

*Primary Examiner* — Matthew Ing
(74) *Attorney, Agent, or Firm* — Barnes & Thornburg LLP

(57) ABSTRACT

A domestic appliance, such as a refrigerator, is configured to be fitted into a furniture body. The furniture body includes a front furniture panel disposed on a front face of a domestic appliance door and includes a pivot joint. The front furniture panel is connected to the front face of the domestic appliance door. A damping device is located between and operatively connected to the domestic appliance door and the front furniture panel. The domestic appliance door is configured as a sliding door which moves relative to the front furniture panel during an opening and closing movement of the domestic appliance door and the front furniture panel.

8 Claims, 11 Drawing Sheets

(56) References Cited

U.S. PATENT DOCUMENTS

| | | | | |
|---|---|---|---|---|
| 2003/0234604 | A1* | 12/2003 | Lin | 312/334.6 |
| 2004/0056573 | A1 | 3/2004 | Chae | |
| 2007/0278917 | A1* | 12/2007 | Yang | 312/330.1 |
| 2007/0278919 | A1* | 12/2007 | Lu | 312/333 |
| 2009/0189499 | A1* | 7/2009 | Yang | 312/334.44 |
| 2009/0273129 | A1* | 11/2009 | Zimmer et al. | 267/170 |

FOREIGN PATENT DOCUMENTS

| | | |
|---|---|---|
| DE | 203 06 043 | 9/2004 |
| JP | 3-274376 | 12/1991 |
| JP | 5-10068 | 1/1993 |

* cited by examiner

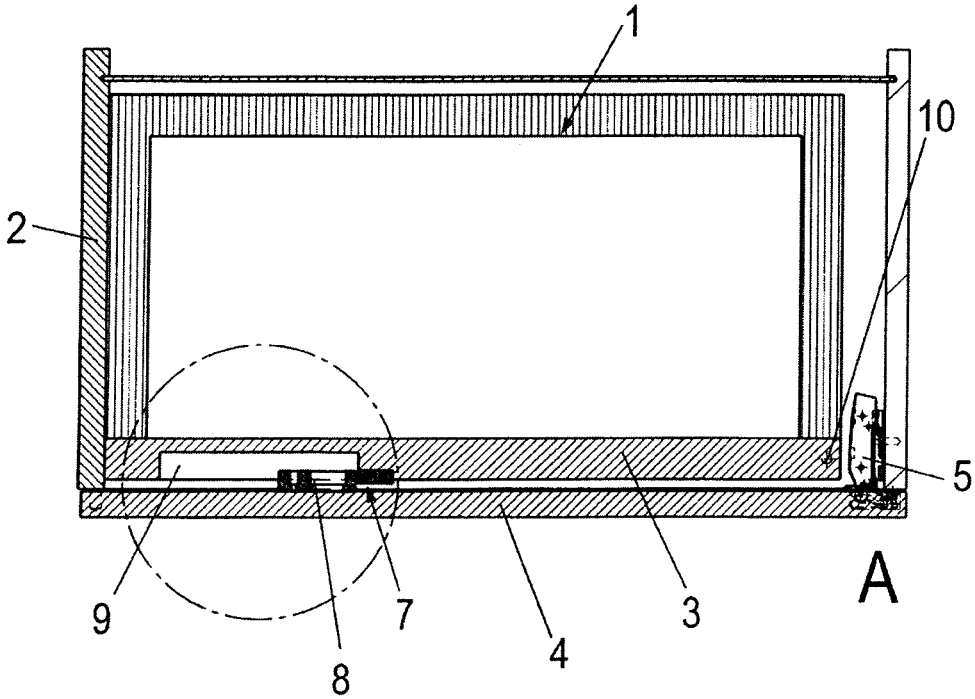
Fig. 3
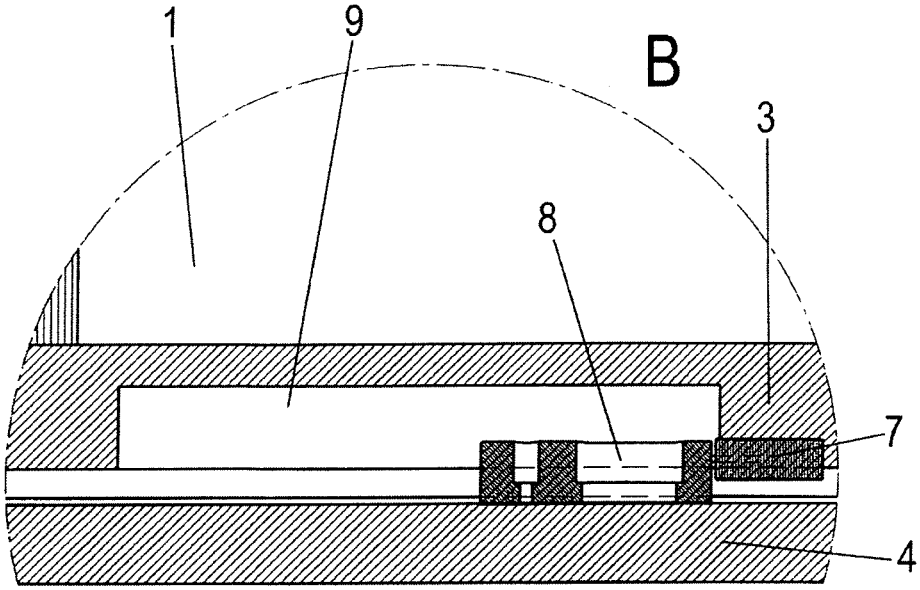

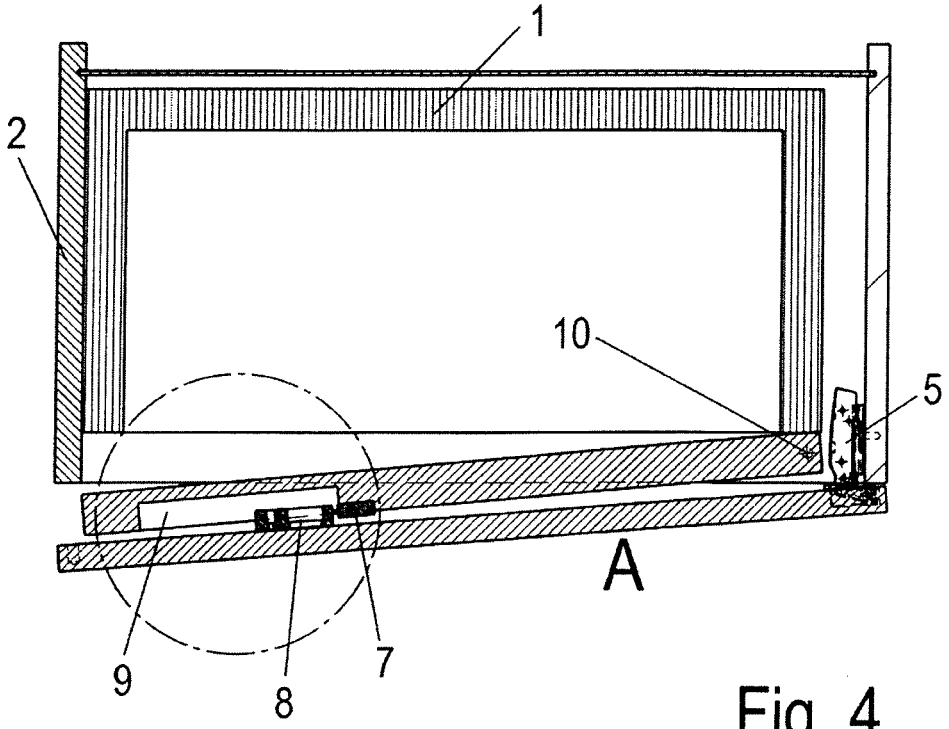
Fig. 4
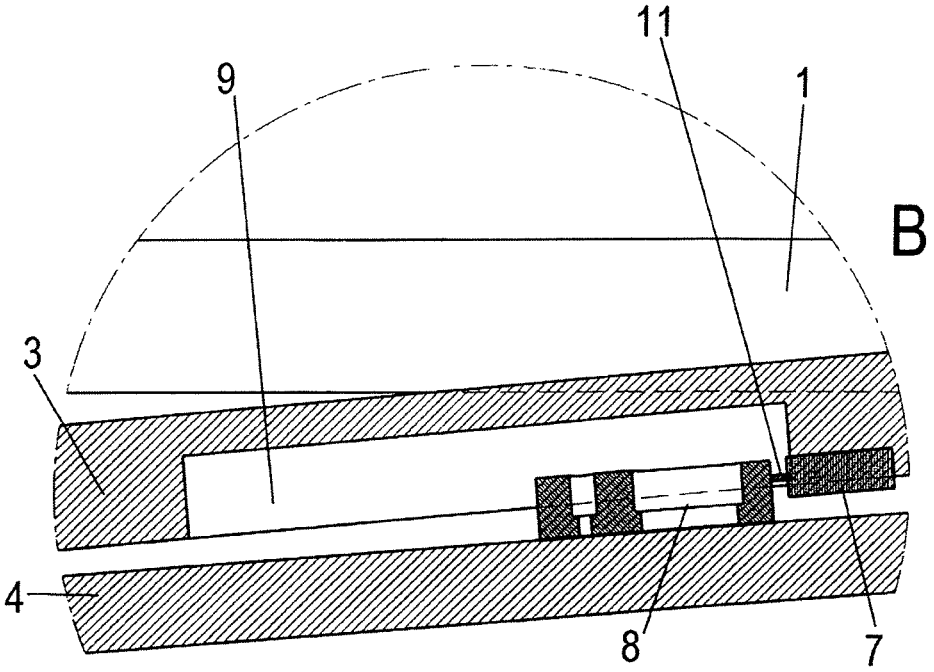

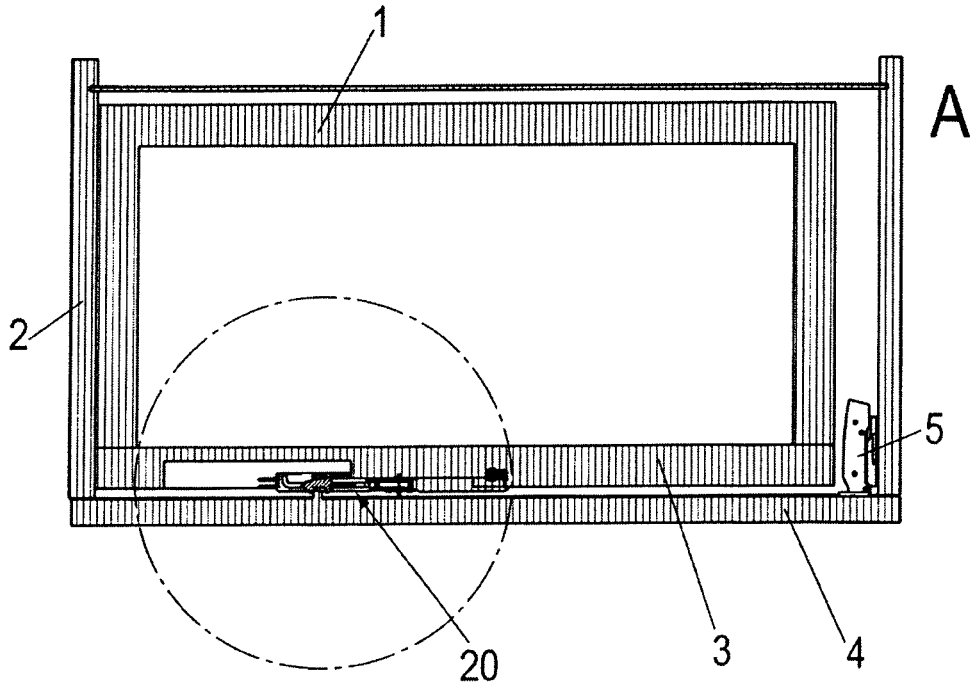
Fig. 7
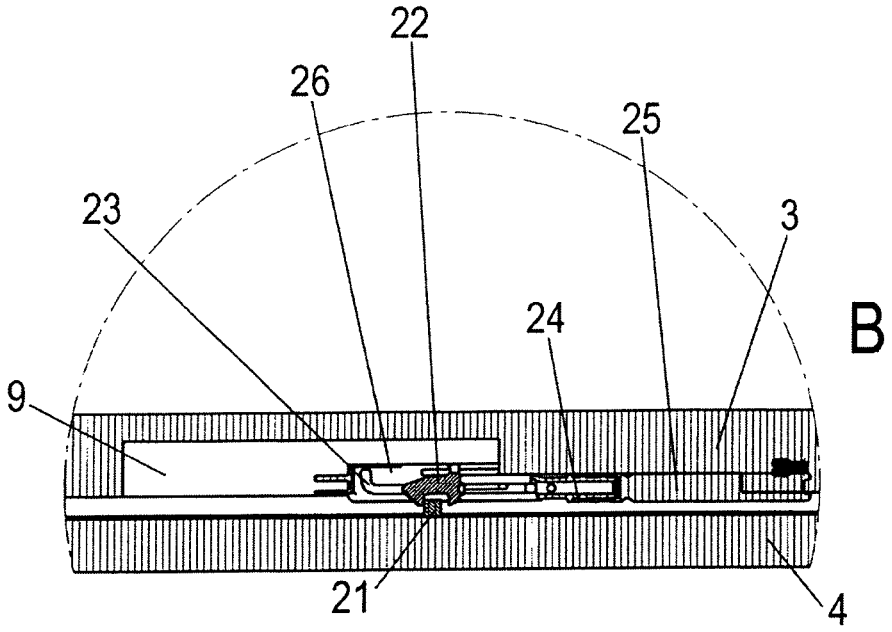

DOMESTIC APPLIANCE

BACKGROUND OF THE INVENTION

The Application is an English-translation of the International Patent Application No. PCT/EP2011/052154 filed on Feb. 14, 2011 to which priority is claimed and priority is also claimed to German Application No. 20 2010 000 209.5 filed on Feb. 16, 2010, the content of which Applications are incorporated by reference herein.

The present disclosure relates to a domestic appliance configured to be fitted into a furniture body, for example, a refrigerator. The domestic appliance includes a front furniture panel disposed on a front face of a domestic appliance door and includes a pivot joint. The front furniture panel is connected to the front face of the domestic appliance door. A damping device is located between and operatively connected to the domestic appliance door and the front furniture panel. The domestic appliance door is configured as a sliding door which moves relative to the front furniture panel during an opening and closing movement of the domestic appliance door and the front furniture panel.

It is known from the prior art to cover such built-in domestic appliances, for example, built-in refrigerators which are built into furniture, with an additional front furniture panel. The front furniture panel is, for example, fixed directly to the refrigerator door so that the refrigerator door can be opened and closed together with the front furniture panel. Another possibility for fixing consists of fitting each of the domestic appliance door and the front furniture panel with a pivot joint in the sense of a so-called sliding door system. The opening and closing of the domestic appliance door is therefore accomplished via two different axes of rotation. The domestic appliance door moves as a sliding door relative to the front furniture panel during the opening and closing.

A disadvantage in the known prior art is that with the closing movement of the domestic appliance door and the front furniture panel, the domestic appliance door is pressed against the frame of the domestic appliance with great force depending on the force applied by the user and this can result in an undesirable development of noise. Embodiments of the present disclosure provide for a domestic appliance configured to be fitted into a furniture body, which embodiments are an improvement in the movement sequence that is brought about during the movement of the domestic appliance door and the front furniture panel.

The improvements include a domestic appliance, such as a refrigerator, configured to be fitted into a furniture body. The furniture body includes a front furniture panel disposed on a front face of a domestic appliance door and includes a pivot joint. The front furniture panel is connected to the front face of the domestic appliance door. A damping device is located between and operatively connected to the domestic appliance door and the front furniture panel. The domestic appliance door is configured as a sliding door which moves relative to the front furniture panel during an opening and closing movement of the domestic appliance door and the front furniture panel. The damping device is configured as a self-retracting device that pulls the domestic appliance door into a closed position via a damped movement using the relative movement of the domestic appliance door and the front furniture panel with respect to each other.

According to embodiments of the present disclosure, a damping device is provided between the domestic appliance door and the front furniture panel, which damping device is operatively connected to the domestic appliance door and the front furniture panel. The damping device, thus disposed, effectively uses the relative movement of domestic appliance door and front furniture panel with respect to one another for a damping of the closing movement of the domestic appliance door and the front furniture panel.

Further embodiments of the present disclosure are discussed below.

According to other embodiments of the present disclosure, the damping device is configured, for example, as a damping cylinder or as a spring element. In a comparatively simple and inexpensive construction, the damping cylinder is pressed into a stop shortly before reaching the closed position, with the result that the remaining movement into the closed position is damped.

According to one of the embodiments of the present disclosure, the damping device is configured as an auxiliary retraction device. This self-retracting device includes, for example, a damper, an entrainer guided in a walking stick curve, a tension spring and an activator. The self-retraction device may be disposed in a recess in the front side of the domestic appliance door. The damper, the entrainer and the tension spring are accommodated in a housing and the activator is disposed on the side of the front furniture panel facing the domestic appliance door, where the entrainer can be moved by the activator against the damping force of the damper into a closed position during a relative movement of the domestic appliance door with respect to the front furniture panel during the closing movement of the domestic appliance door and the front furniture panel.

By using such a self-retraction device as a damping device, the domestic appliance door is additionally pulled into its closed position in a damped movement, in accordance with the present disclosure.

According to a further embodiment of the present disclosure, the damping device is disposed transversely to the relative movement in order to be able to absorb the forces of the relative movement as far as the closed position. This is done with a suitable mechanism such as, for example, two contacting skew planes.

According to yet another embodiment of the present disclosure, the damping device is configured as a radial damper in order to be able to absorb and damp the linear relative movement between domestic appliance door and the front furniture panel. The radial damper can, for example, be embedded in the domestic appliance door or the front furniture panel and be provided with a gear wheel, where the gear wheel engages with a rack on the opposite front furniture panel or domestic appliance door for damping.

Embodiments of the present disclosure are also discussed in the appended claims.

Other aspects of the present disclosure will become apparent from the following descriptions when considered in conjunction with the accompanying drawings.

BRIEF DESCRIPTION OF THE DRAWINGS

FIGS. 3 to 6 show the domestic appliance and furniture body of FIGS. 1 and 2 in a plan view with different opening angles of the domestic appliance door and the front furniture panel, and an embodiment of a damping device, in accordance with the present disclosure.

FIGS. 7 to 11 show views of the domestic appliance and furniture body of FIGS. 1 and 2 in different opening angles of the domestic appliance door and the front furniture panel, and another embodiment of a damping device, in accordance with the present disclosure.

DETAILED DESCRIPTION

Figure 1:
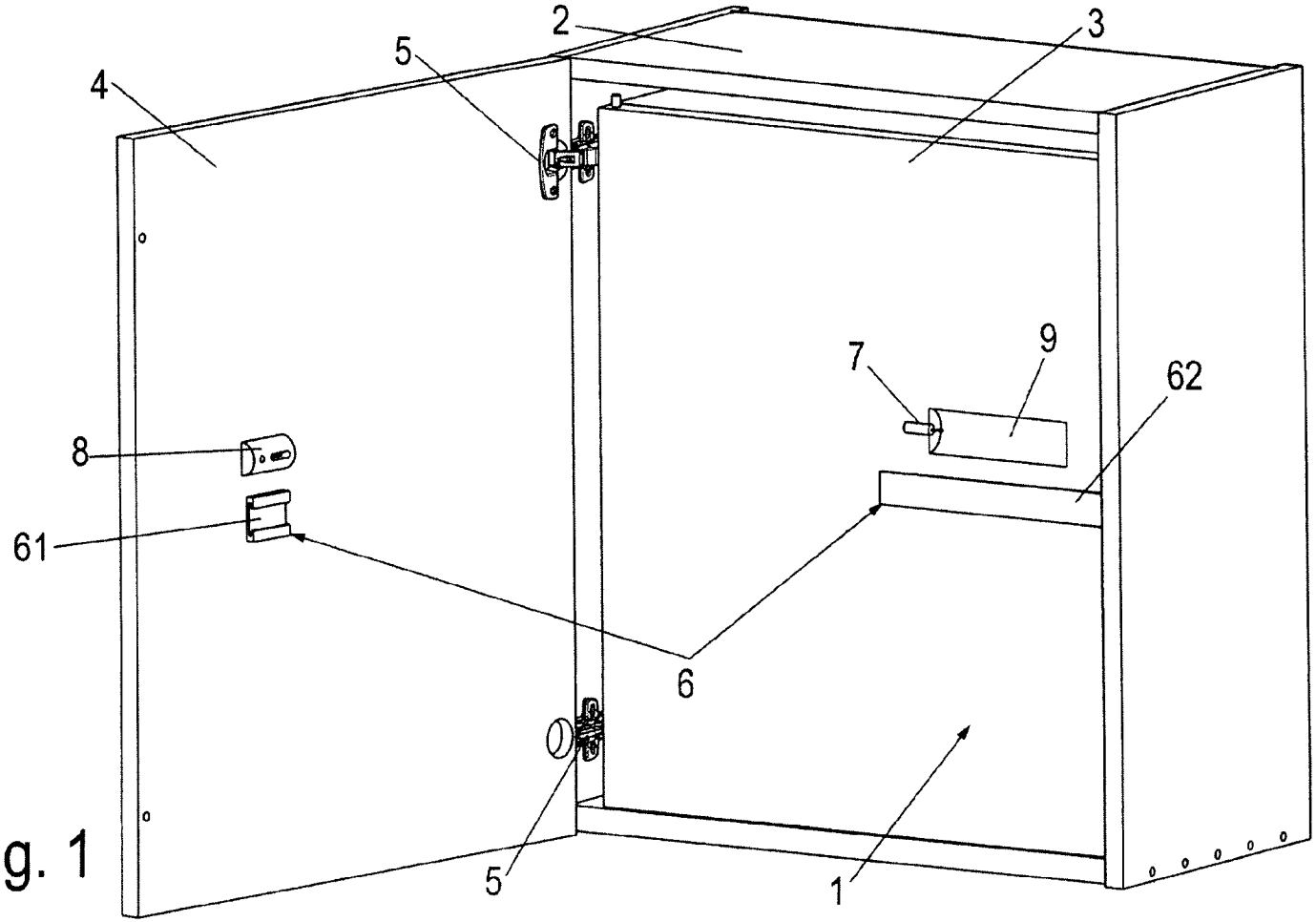
FIG. 1 shows a perspective view of a domestic appliance built into a furniture body with an open front furniture panel, in accordance with the present disclosure.
Figure 2:
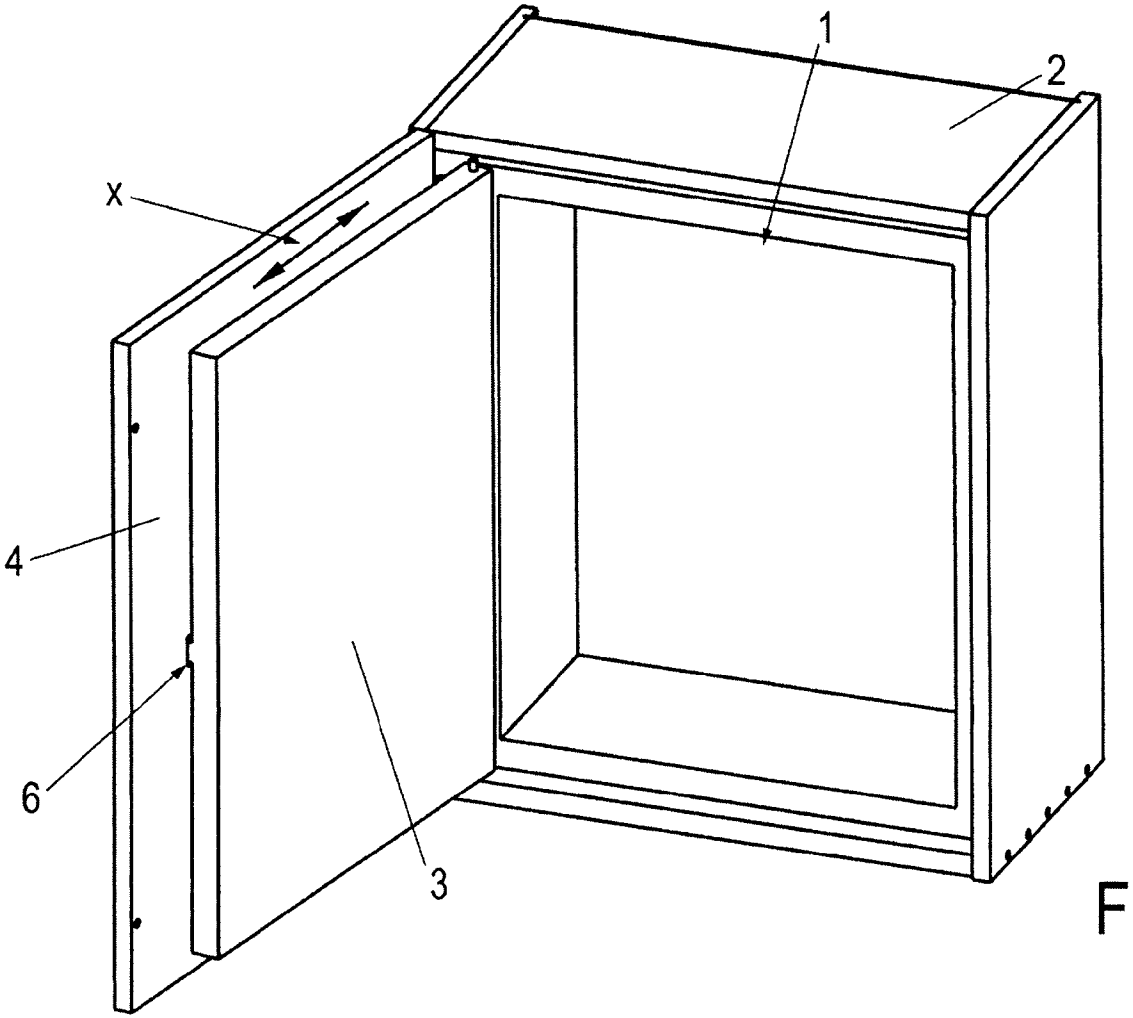
FIG. 2 shows a perspective view of the built-in domestic appliance with an open domestic appliance door, in accordance with the present disclosure.
Figure 5:
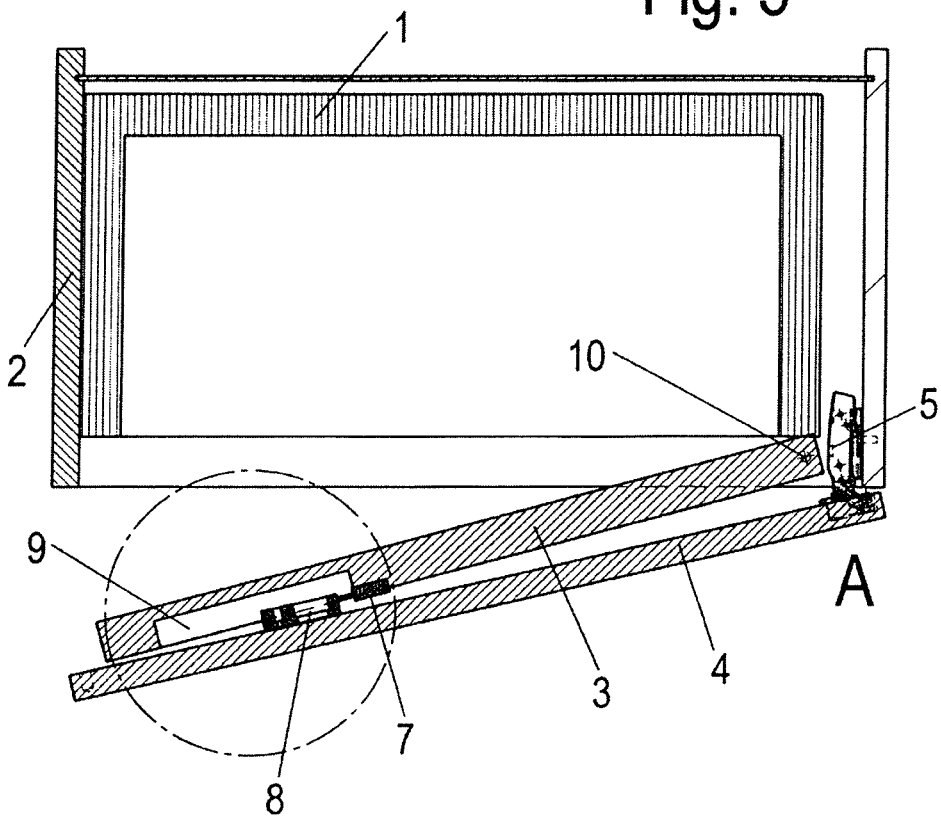
Figure 5:
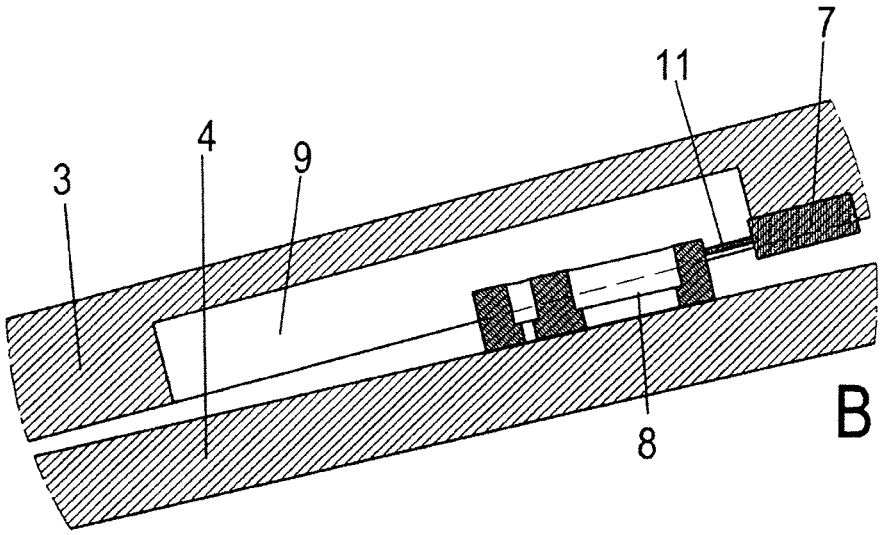
Figure 6:
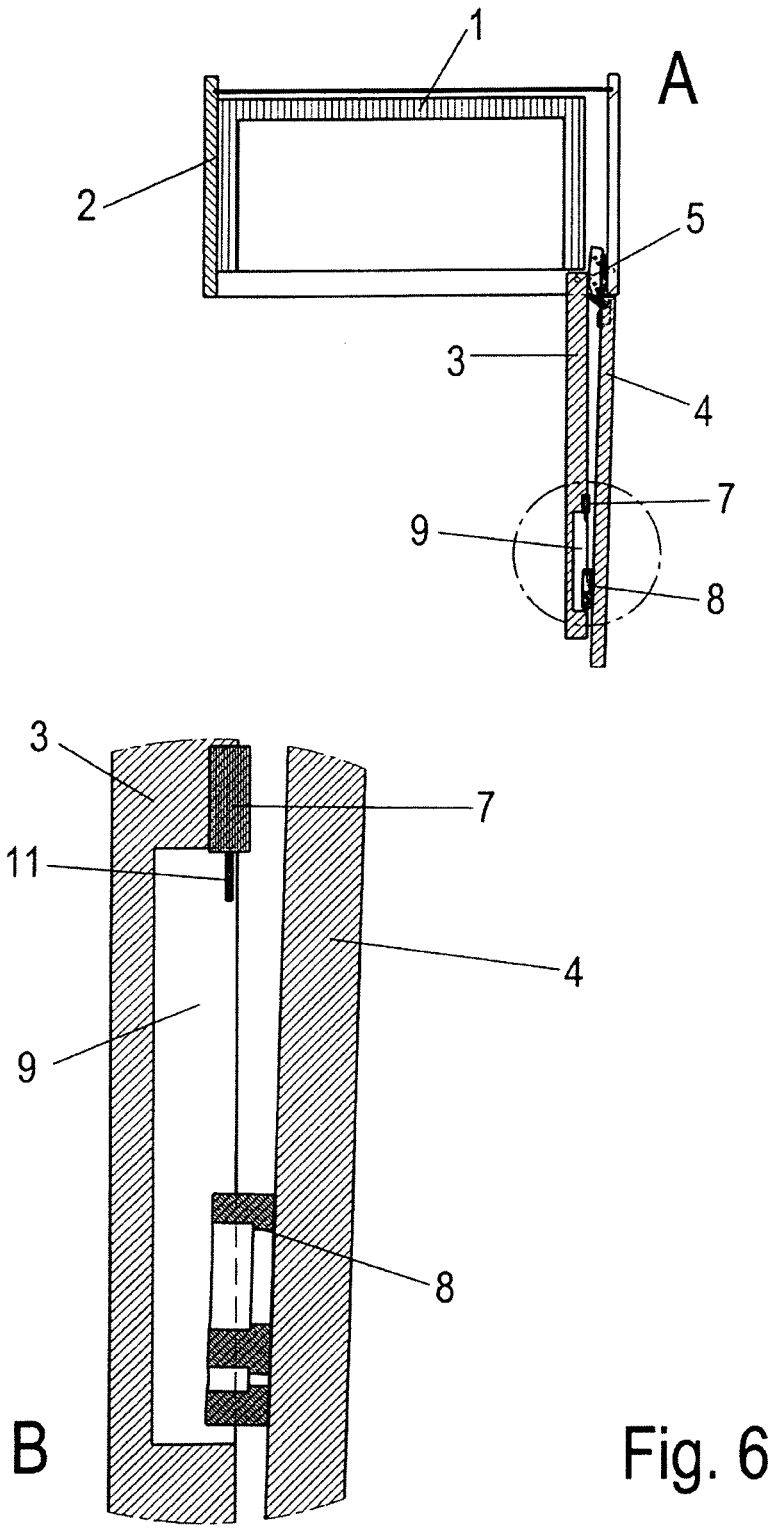
Figure 8:
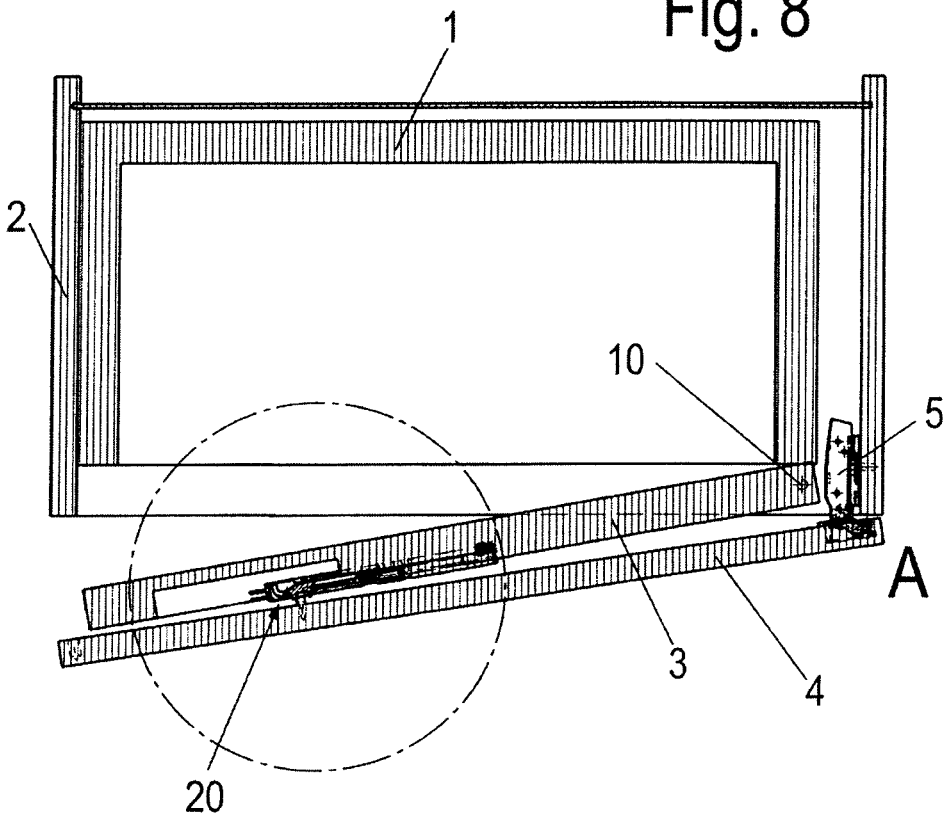
Figure 8:
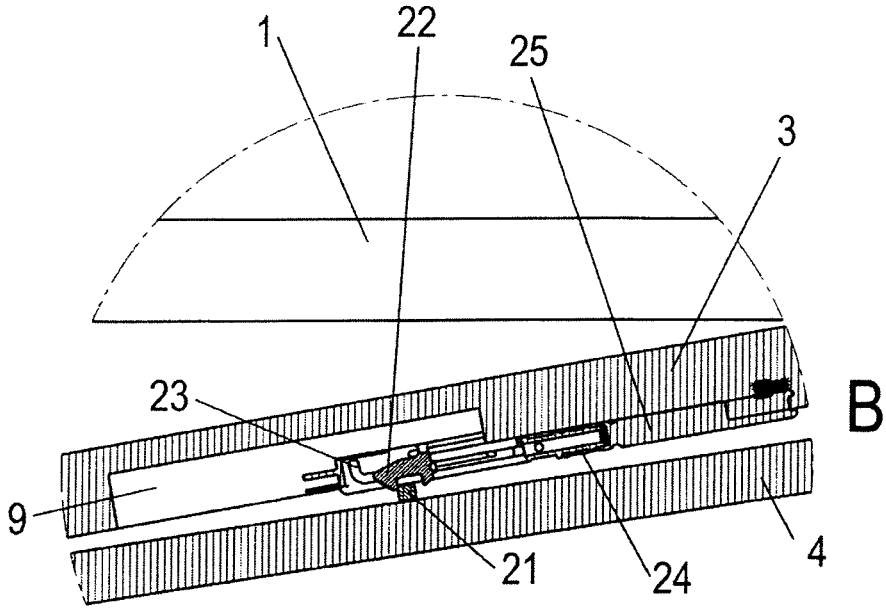
Figure 9:
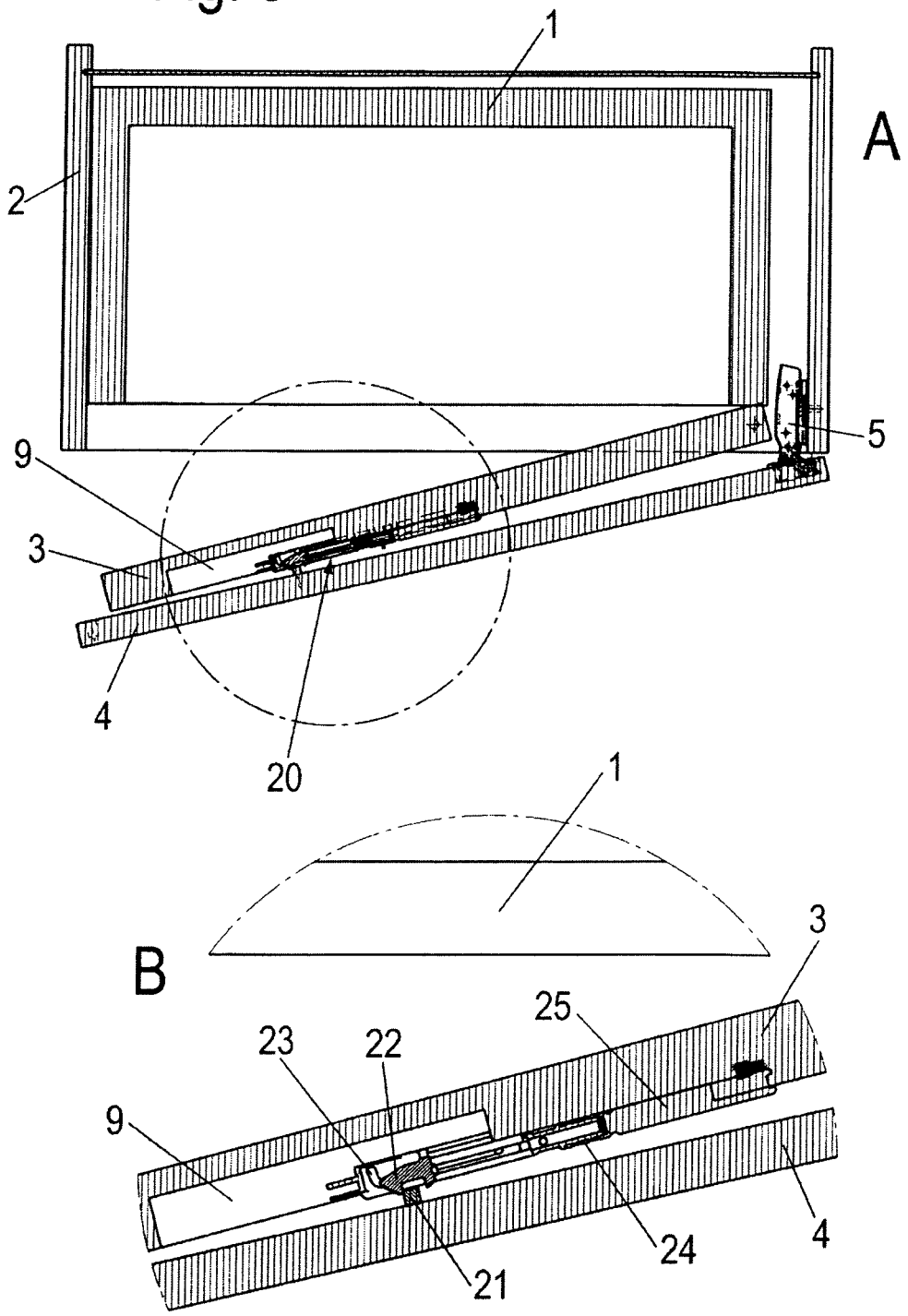
Figure 10:
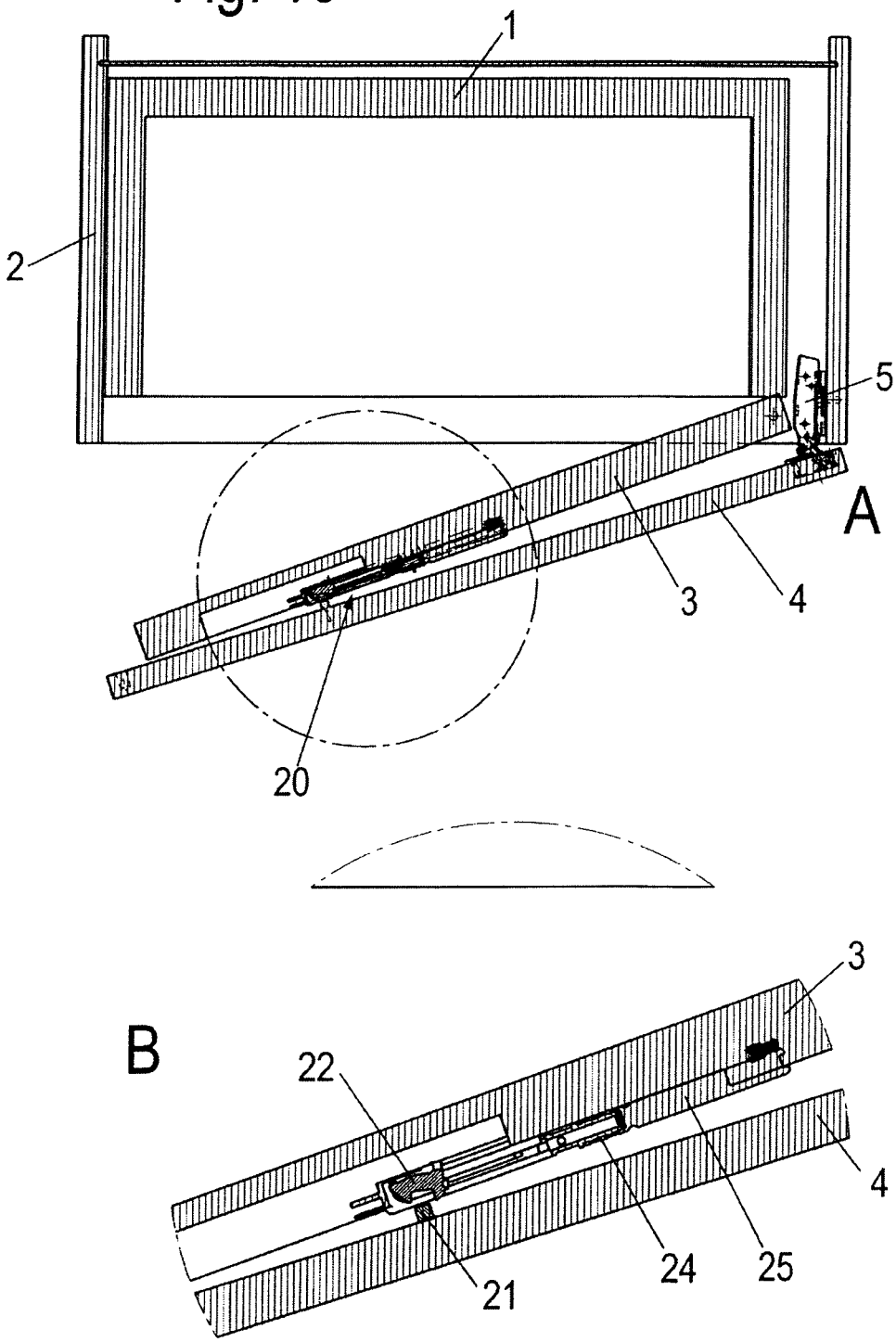
Figure 11:
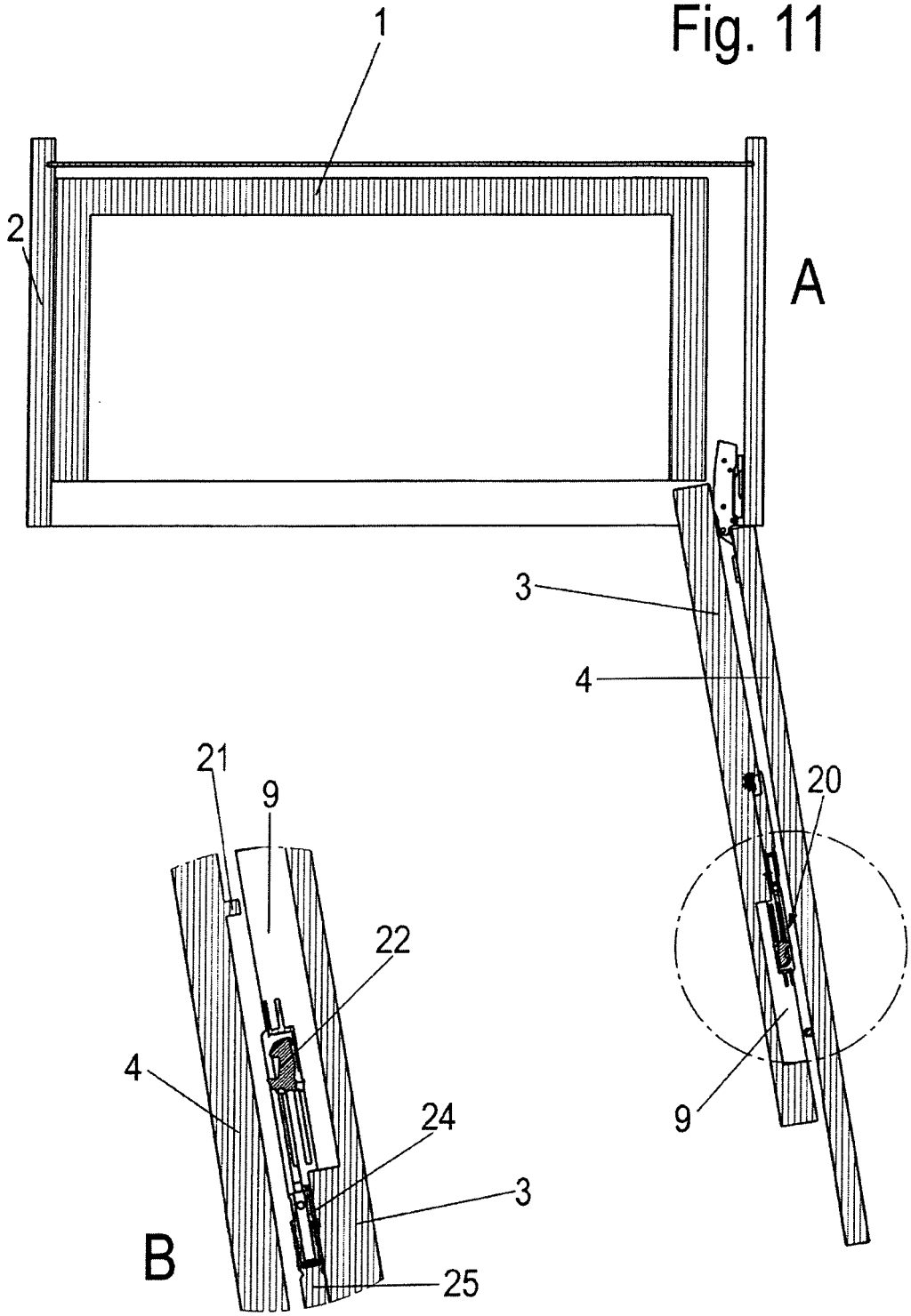

In FIG. 1 the reference number 1 denotes a domestic appliance configured, for example, as a refrigerator, that is built into a furniture casing 2, also called a furniture housing or body. In the furniture casing 2, a front furniture panel 4 is fixed pivotably by concealed hinges 5. The panel 4 may be connected via a prismatic joint 6 to a domestic appliance door 3 of the domestic appliance 1. In the embodiment shown in FIG. 1, a clip 61 is fixed on the inner side of the front furniture panel 4 facing the domestic appliance door 3. The clip 61, together with a rail 62 fixed in the horizontal direction on the outer side of the domestic appliance door 3 forms the prismatic joint 6 where the rail 62 is held horizontally displaceably in the clip 61.

Furthermore, a stop 8 is disposed on the side of the front furniture panel 4 facing the domestic appliance door 3, against which a damping device 7, configured as a damping cylinder 7, is pressed when the domestic appliance door 3 and the front furniture panel 4 are moved from an open position, in which the domestic appliance 1 is open, into a closed position in which the domestic appliance 1 is closed. Since the pivoting of the domestic appliance door 3 takes place about a different axis of rotation 10 from that of the front furniture panel 4, the front furniture panel 4 and the domestic appliance door 3 move approximately parallel to one another in the horizontal direction during the closing movement or during an opening movement. This sliding movement between the door 3 and front furniture panel 4 is used for damping the closing movement.

The damping cylinder 7 is disposed in an intermediate space between the domestic appliance door 3 and the front furniture panel 4. In order to keep the distance between domestic appliance door 3 and front furniture panel 4 as small as possible, in the embodiment shown in FIG. 1, for example, a recess 9 is provided on the outer side of the domestic appliance door 3, in which the damping device 7 is disposed. The recess 9 is configured, for example, as an elongated hole, where the length of the elongated hole is dimensioned so that the stop 8 rests in the elongated hole at every opening angle of the door 3 or front furniture panel 4. The stop 8 and the damping device 7 are positioned with respect to one another in such a manner that a closing movement of the domestic appliance door 3 and the front furniture panel 4 can be damped shortly before reaching the final closed position. To this end, as shown in FIGS. 3 to 6, the stop 8 presses a damper piston 11 completely into the damping cylinder 7 in the closed position of the domestic appliance door 3 and the front furniture panel 4. With an increasing opening angle, the damper piston 11 projects further from the damping cylinder 7 until a position is reached in which the stop 8 is no longer in contact with the damping device 7. The outward movement of the damper piston 11 can, for example, be brought about by a compression spring disposed in the damping cylinder 7 and operatively connected to the damping piston 11. Alternatively, and within the scope of the present disclosure, the pressing out of the damper piston 11 can be accomplished pneumatically. If the domestic appliance 1 is to be closed again, the stop 8 comes in contact with the piston 11 of the damping cylinder 7 from a specific opening angle, for example, at an opening angle between 10 and 20°, so that the remaining movement of the domestic appliance door 3 and the front furniture panel 4 is damped by the damping force of the damping cylinder 7.

In an embodiment of the present disclosure shown in FIGS. 7-11, the damping device is configured as a self-retraction device 20. The self-retraction device 20 includes, as shown in FIG. 7*b*, for example, a damper 25, an entrainer 22 guided in a walking stick curve 23, a tension spring 24 and an activator 21 which covers the entrainer 22 in the walking stick curve 23. To this end, the self-retraction device 20 is disposed in a recess 9 in the front side of the domestic appliance door 3. The damper 25, the entrainer 22 and the tension spring 24 are, for example, accommodated in a housing 26 and the activator 21 is disposed on the side of the front furniture panel 4 facing the domestic appliance door 3, where the entrainer 22 can be moved by the activator 21 against the damping force of the damper 25 into the closed position during a relative movement of the domestic appliance door 3 with respect to the front furniture panel 4 during a closing movement of the domestic appliance door 3 and the front furniture panel 4. The closed position is shown in FIGS. 7A and 7B. An arrangement of the damping device 20 on the front furniture panel 4 and the activator 21 on the domestic appliance door 3 is within the scope of the present disclosure.

Referring to FIGS. 7-11 for the domestic appliance door 3 and the front furniture panel 4, at different opening angles with respect to the domestic appliance 1, the activator 21 is brought close to the entrainer 22 during the door closing (see FIG. 10B), where the entrainer 22 is located in the bent end of the walking stick curve 23. During the further closing movement, the entrainer 22 is anchored with the activator 21 and during the further movement into the closed position, the entrainer 22 presses a piston of damper 25 into the damper 25 so that the remaining movement into the closed position takes place in a damped manner. If the domestic appliance door 3, configured, for example, as a refrigerator door, is then opened, the activator 21 pulls the entrainer 22, and thus the damper piston, from the damper 25 until the entrainer 22 in the walking stick curve 23 dips into the end piece of the walking stick curve 23 again and thus releases the activator 21.

According to a further embodiment of the present disclosure, the damping device can, for example, be disposed transverse to the relative movement in order to absorb the forces of the relative movement as far as the closed position. This may, for example, be done with a suitable mechanism such as, for example two contacting skew planes.

In a further embodiment of the present disclosure, the damping device may, for example, be configured as a radial damper in order to absorb and damp the linear relative movement between domestic appliance door 3 and the front furniture panel 4. The radial damper can, for example, be embedded in the domestic appliance door 3 or the front furniture panel 4 and be fitted with a gear wheel, where the gear wheel engages with a rack on the opposite front furniture panel 4 or domestic appliance door 3 for damping.

Although the present disclosure has been described and illustrated in detail, it is to be clearly understood that this is done by way of illustration and example only and is not to be taken by way of limitation. The scope of the present disclosure is to be limited only by the terms of the appended claims.

We claim:

1. A domestic appliance including a door pivotable about a first axis of rotation fitted into a furniture body including a front furniture panel pivotable about a second axis of rotation, the second axis of rotation parallel to and spaced from the first axis of rotation, the front furniture panel is connected to the front face of the domestic appliance door such that the domestic appliance door moves slidingly and pivotably with respect to the front furniture panel during an opening and closing movement of the domestic appliance door, and a damping device is located between and comprises elements connected to the domestic appliance door and the front furniture panel, wherein the damping device is configured as a self-retracting device comprising an activator mounted on one of the domestic appliance door and the furniture panel and an entrainer mounted on the other of the domestic appliance door and the furniture panel wherein the movement of the domestic appliance door and the furniture panel moves the activator and a portion of the one of the domestic appliance door and the furniture panel to which the activator is mounted transversely toward or away from the entrainer and a portion of the other of the domestic appliance door and the furniture panel to which the entrainer is mounted, wherein the self-retracting device pulls the domestic appliance door into a closed position via a damped movement using the relative movement of the domestic appliance door and the front furniture panel with respect to each other.

2. The domestic appliance according to claim 1, wherein the entrainer is guided in a walking stick curve, and the self-retracting device further comprises a tension spring.

3. The domestic appliance according to claim 2, wherein the self-retracting device is disposed in a recess in the front face of the domestic appliance door, wherein the damper, the entrainer and the tension spring are accommodated in a housing and the activator is disposed on a side of the front furniture panel facing the domestic appliance door, further wherein the entrainer is configured to be moved by the activator against a damping force of the damper into a closed position during a relative movement of the domestic appliance door with respect to the front furniture panel during the closing movement of the domestic appliance door and the front furniture panel.

4. The domestic appliance according to claim 1, wherein the front furniture panel and the front face of the domestic appliance door are interconnected by a prismatic joint.

5. The domestic appliance according to claim 4, wherein the damping device is operatively connected to the prismatic joint.

6. The domestic appliance according to claim 1, the damping device further comprising a tension spring disposed on the domestic appliance door.

7. The domestic appliance according to claim 1, wherein the activator is engaged with the entrainer when the domestic appliance door and the furniture panel are in a closed position and wherein the activator is disengaged from the entrainer when the domestic appliance door and the furniture panel are in an open position.

8. The domestic appliance according to claim 1, wherein the activator selectively engages with and disengages from the entrainer when the domestic appliance door and the furniture panel are moved between open and closed positions.

* * * * *